United States Patent [19]

Chambolle

[11] 4,006,682

[45] Feb. 8, 1977

[54] ARRANGEMENT FOR FITTING AND TENSIONING AN ENDLESS CHARACTER-BEARING BAND IN A PRINTER

[75] Inventor: Jacques Andre Louis Marie Chambolle, Danjoutin, France

[73] Assignee: Compagnie Honeywell Bull (Societe Anonyme), Paris, France

[22] Filed: Dec. 1, 1975

[21] Appl. No.: 636,455

[30] Foreign Application Priority Data

Dec. 11, 1974 France ..... 74.40831

[52] U.S. Cl. ..... 101/111; 101/93.14

[51] Int. Cl.[2] ..... B41J 1/20

[58] Field of Search ..... 101/111, 93.13, 93.14; 197/53, 168; 74/240–242

[56] References Cited

UNITED STATES PATENTS

| | | | |
|---|---|---|---|
| 3,772,988 | 11/1973 | Bowers et al. | 101/111 |
| 3,805,697 | 4/1974 | Mahe | 101/111 |
| 3,805,698 | 4/1974 | Bowers et al. | 101/111 |

OTHER PUBLICATIONS

Kraemer, IBM Technical Disclosure Bulletin, vol. 13, No. 11, Apr., 1971, pp. 3366–3367.

Iobst et al., IBM Technical Disclosure Bulletin, vol. 15, No. 4, Sept., 1972, p. 1234.

*Primary Examiner*—Edward M. Coven

*Attorney, Agent, or Firm*—Baldwin, Wight & Brown

[57] ABSTRACT

This disclosure relates to a construction in a printer of the type utilizing an endless character-bearing band which is carried in a cartridge and which is mounted in the printer on two pulleys in a tensioned state, the construction including means for changing the spacing of the two pulleys only after a cartridge has been placed within the printer with the means being in the form of a key which rotates a cam and which key has associated therewith means for moving a protective member relative to the band when the key is in an operative position. The construction further includes locking means for preventing the insertion of the key into an operative position until such time as a cartridge is in position and the cover of the printer has been closed.

10 Claims, 10 Drawing Figures

Figure 1A:
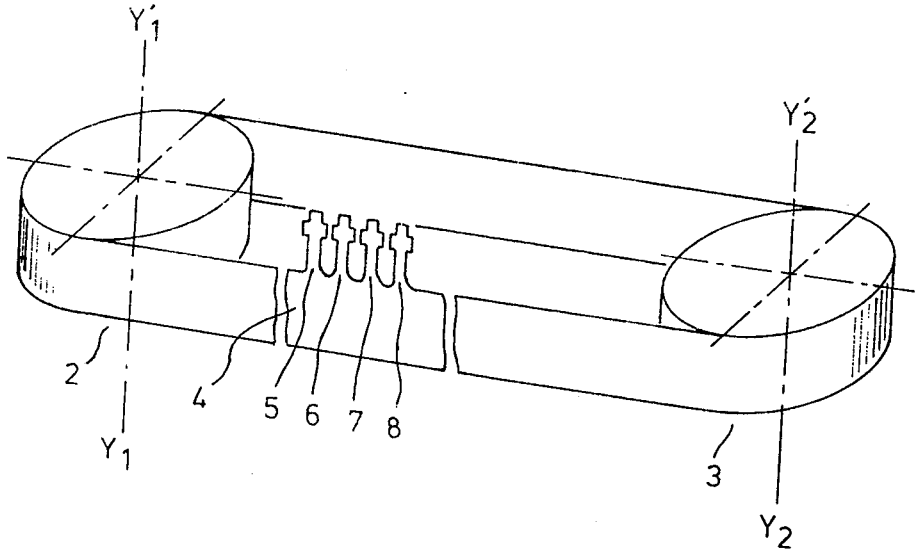

FIG·5b
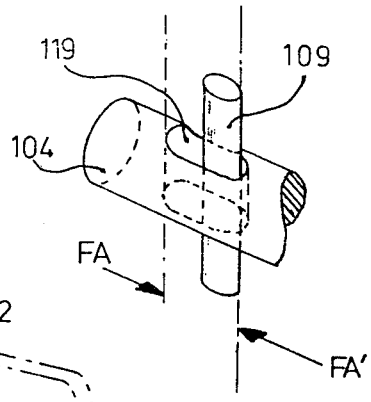
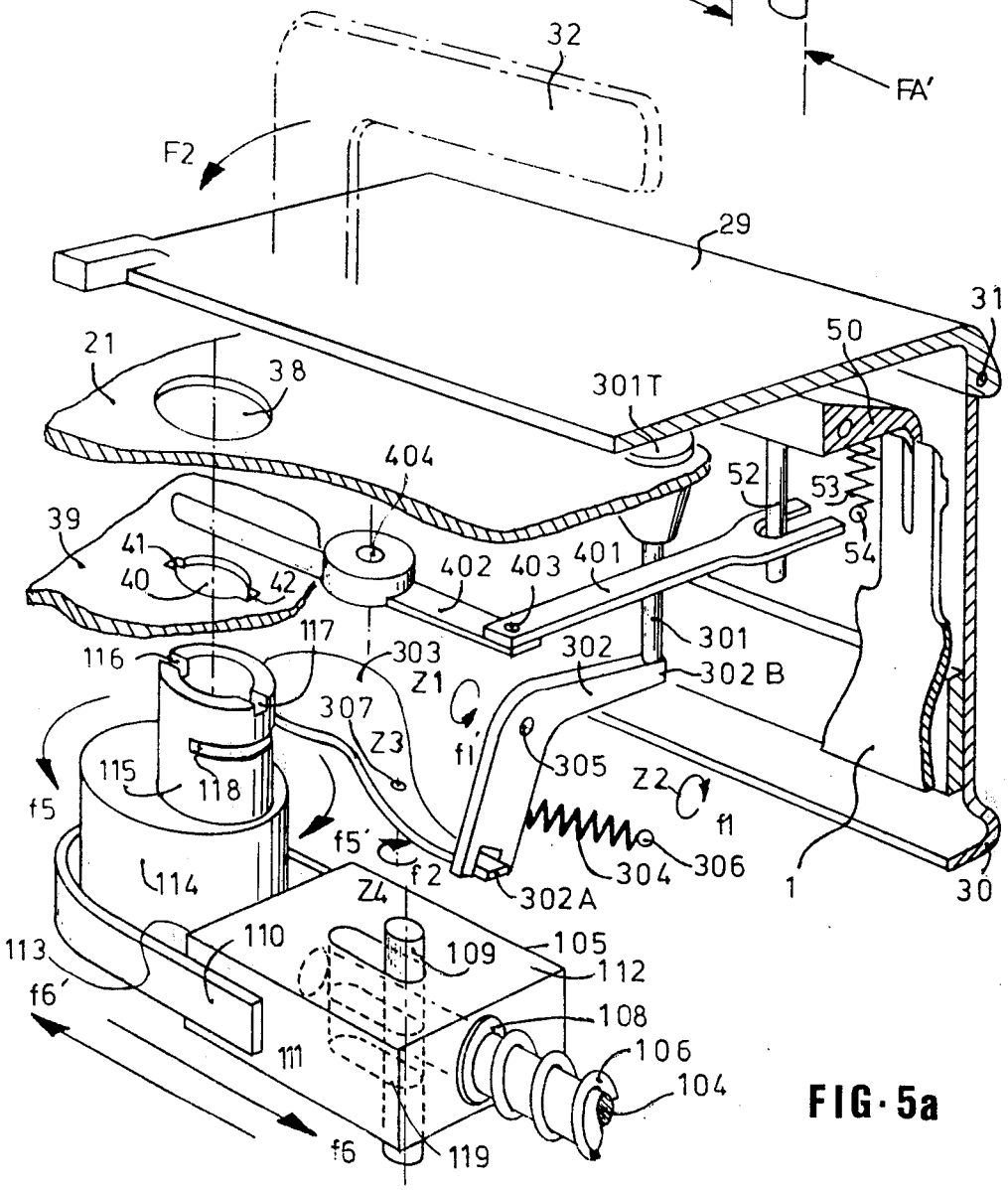
FIG·5a

ARRANGEMENT FOR FITTING AND TENSIONING AN ENDLESS CHARACTER-BEARING BAND IN A PRINTER

This invention relates to an arrangement for fitting and tensioning an endless character-bearing band in a printer.

At the present time printers having endless character-bearing bands are preferred to drum printers by reason, on the one hand, of the better standard of print which they give and, on the other hand, of their higher printing speed, that is to say the number of lines of print they are able to write per minute.

Endless character-bearing bands are well known. A description of such bands is to be found, for example, in U.S. Pat. No. 3,884,211 which was granted on Oct. 24, 1974. This band is a flexible metallic band made of steel the upper edge of which is provided with a plurality of character-bearing fingers in the form of flexible tongues, the fingers being grouped into a whole number of identical sets of different characters.

In the printer the band is mounted under tension on two pulleys whose axes of rotation are vertical and parallel, so that the character-bearing fingers move horizontally with a uniform linear motion between, on the one hand, a print support (paper and inking ribbon) and an anvil, and on the other hand, a stroker assembly which consists of a plurality of actuators each of which is capable of applying striking pulses successively to characters via a strike hammer.

The tasks which may be performed by a printer vary. Among them may be mentioned.

1. The printing of bills and payslips, which makes it necessary to use sets of characters on the band which include both numbers and also the letters of the English alphabet. Such a set of characters is termed a "set of alphanumeric characters".

2. Printing the results of scientific calculations, which makes it necessary to use sets of characters which are different from those sets of alphanumeric characters which are defined in (1) in the case of bills and payslips, and which may, for example contain more characters, as well as certain letters of the Greek alphabet.

3. Printing texts in foreign languages, in particular French, German Arabic, etc., which makes it necessary to use sets of characters which consist of sets of alphanumeric characters which differ from those defined under (1) in the case of the English language.

To change over from one type of task to another, which frequently occurs, it is thus necessary to change the characterbearing band.

To replace a first character-bearing band by a second it is necessary:

a. to relax the first band and then remove it from the printer b. to fit the second band and then tension it on the two pulleys.

Whenever a band is changed, this entails stopping the printer, which is expensive for the user. It is, therefore, necessary to reduce the down-time and consequently to make the operation of relaxing and removing the first band, and fitting and tensioning the second band, as simple and quick as possible.

For this purpose, the distance between the axes of rotation of the pulleys is adjustable. The first pulley, the position of which is fixed, is mounted on a shaft which is driven by an electric motor. The second pulley is mounted on a shaft which can be moved in translation in a direction perpendicular to the said axes of rotation between two positions:

a first position in which the pulleys are at their closest and the band is not under tension. Because of this the band can easily be fitted. In this case the pulleys are said to be in the closed-up position.

a second position in which the pulleys are at their maximum separation and in which the band is tensioned and is in the printing position. The pulleys are then said to be in the opened-out position.

It is current practice to associate a detachable cartridge containing the band with an arrangement for closing up and opening out the pulleys, the use of a cartridge minimizing the risk of damanging the band and in particular the character-bearing fingers, when the band is being fitted or removed.

Such a cartridge is described in U.S. Pat. No. 3,805,697 which was granted Apr. 23, 1974. It consists of a casing which is capable of enclosing the pulleys whatever their relative positions (closed up or opened out). This casing includes on the one hand an outer part which is secured to the shaft of the first pulley and remains fixed once the cartridge has been fitted into the printer, and on the other hand an inner shell which is secured to the shaft of the second pulley. This inner shell slides within the outer casing when the second pulley is moved towards (or away from) the first pulley. It is clear that, because it is secured to the shaft of the second pulley, the inner shell slides within the outer casing in the direction in which the movable pulley moves in translation.

By analogy with the relative positions of the two pulleys, the inner shell is said to be in the closed-up position in the outer casing when the pulleys are in the closed-up position and in the opened-out position in the outer casing when the pulleys are in the opened-out position.

When stored, the character-bearing band is held firmly in position within the cartridge by being held to a strip of magnetized material part of which is arranged on the inside wall of the outer casing and another part of which is arranged on the inner wall of the inner shell, which at this time is in its closed-up position in the outer casing.

When the cartridge is fitted into the printer and the second pulley is moved away from the first pulley, the endless character-bearing band comes away from the strip of magnetized material and moves across onto the pulleys. Similarly, when the second pulley is moved towards the first pulley, the character-bearing band comes free of the pulleys and moves back onto the strip of magnetized material in the cartridge.

Various types of arrangements for moving the pulleys apart or together are known. One such arrangement includes a manually-operated screw the end of which cooperates with the shaft of the second pulley, this screw being capable of movement within a thread formed in the framework of the printer. Depending upon the direction in which the screw is turned the second pulley is moved either towards or away from the first pulley.

This arrangement, though simple, is nevertheless difficult and hard to operate (the pulley being fairly heavy) and not very accurate as a tensioner (it is never known whether the belt is correctly tensioned or not).

Furthermore, it does not allow the following types of misuse to be prevented:

a. fitting the detachable cartridge when the pulleys are in the opened-out position while the inner shell is in the closed-up position in the outer casing.

b. relaxing the band, once it has been fitted to the printer and is in the printing position, while the printer is operating.

In another arrangement for moving the pulleys apart or together a carriage is used which supports the shaft of the movable pulley and is mounted on ball-race sliders. The carriage incorporates a roller which cooperates with a helical cam. The helical cam is mounted on a shaft whose axis of rotation is perpendicular to the axis of rotation of the two pulleys and lies in the plane defined by the latter. Whenever the shaft carrying the cam is turned in either direction this causes the carriage to move on its sliders and, as a result the two pulleys to move apart or together.

This arrangement, although extremely accurate, is nevertheless delicate and costly. Although it prevents the types of misuse mentioned above (a) and (b), the safety measures employed are complicated.

This invention allows these shortcomings to be substantially reduced or overcome. It relates to an arrangement for fitting and tensioning an endless character-bearing band in a printer, which is simple and inexpensive. In addition, when the printer contains a member for protecting the character-bearing fingers, the arrangement according to the invention prevents the protecting device from damaging the character-bearing band when the pulleys are being moved from the closed-up position to the opened-out position and vice versa.

In the arrangement according to the invention for fitting and tensioning an endless character-bearing band in a printer, the endless character-bearing band has a plurality of character-bearing fingers and is mounted on two pulleys whose axes of rotation are parallel. The distance between the axes of rotation is adjustable between a position in which the pulleys are closed up and the band is not under tension, and a position in which the pulleys are opened out and the band is under tension.

The arrangement according to the invention comprises:

- a detachable cartridge containing the band,
- a system for opening out the pulleys,
- a member for protecting the character-bearing fingers, and it is characterized in that it further includes:

- means for operating the device for protecting the fingers,
- a locking means,
- a member for actuating the device for opening out the pulleys, which, at the beginning of operations, is unlocked by the locking means, the locking means being itself actuated by the detachable cartridge when the cartridge is fitted into the printer. The member then operates, on the one hand, the device for opening out the pulleys and, on the other hand, the means for operating the member for protecting the fingers so that the latter comes into position above the character-bearing fingers. The actuating member is locked again at the end of operations when the endless character-bearing band has been tensioned.

Other features of the invention will become apparent from the following description, which is given as a non-limiting example, and by referring to the accompanying drawings.

Figure 1B:
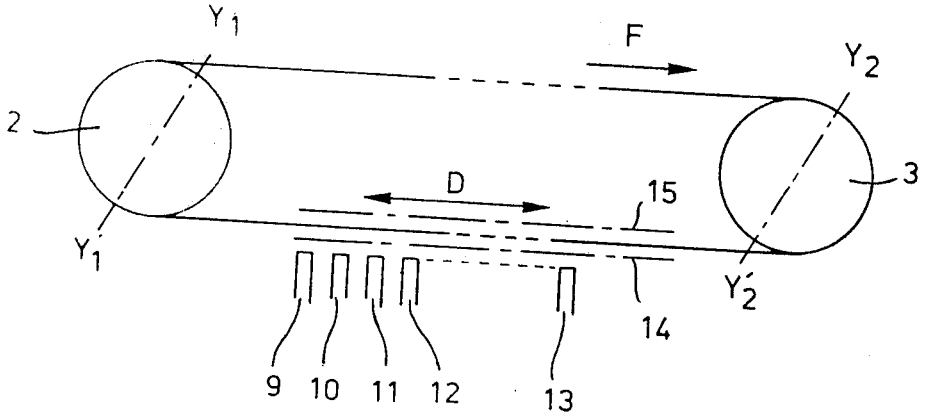
Figure 2:
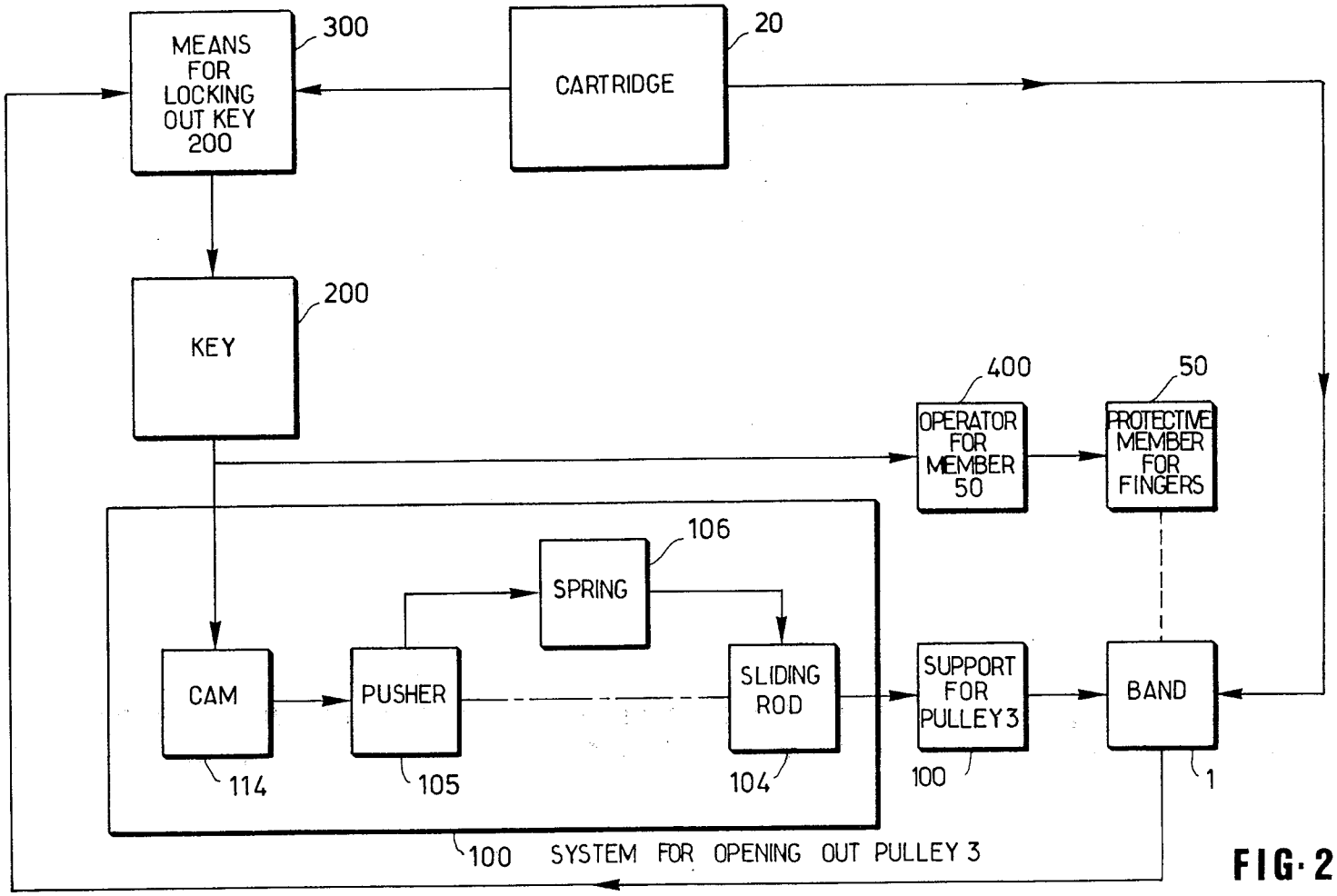
Figure 3A:
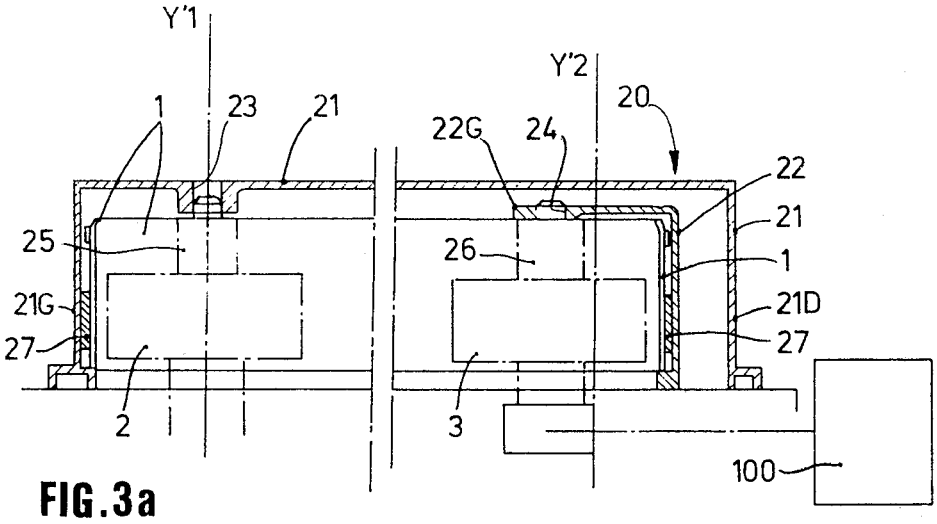
Figure 3B:
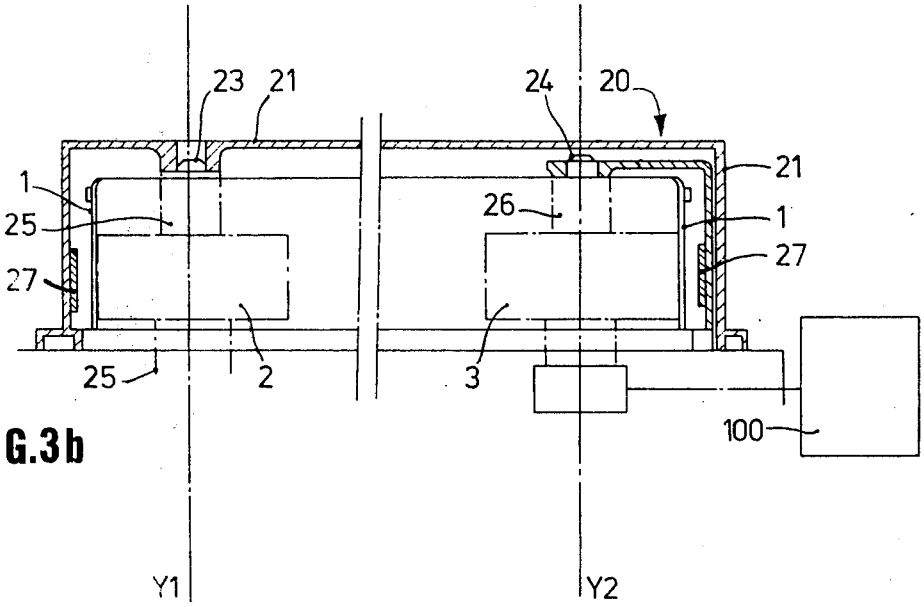

In the drawings:

FIGS. 1*a* and 1*b* are simplified diagrammatic showing the principle of a printer which employs an endless characterbearing band, with FIG. 1*a* being a perspective view and FIG. 1*b* being a plan view;

FIG. 2 is a diagrammatic view in the form of a functional block-diagram showing the principle of the arrangement according to the invention for fitting and tensioning the endless character-bearing band;

FIGS. 3*a* and 3*b* are schematic longitudinal sectional views through the detachable cartridge parallel to the plane which contains the axes of rotation of the pulleys with the pulleys being shown in phantom; FIG. 3*a* showing the cartridge as it appears when the two pulleys are closed up and FIG. 3*b* showing the cartridge as it appears when the two pulleys are opened out.

Figure 4:
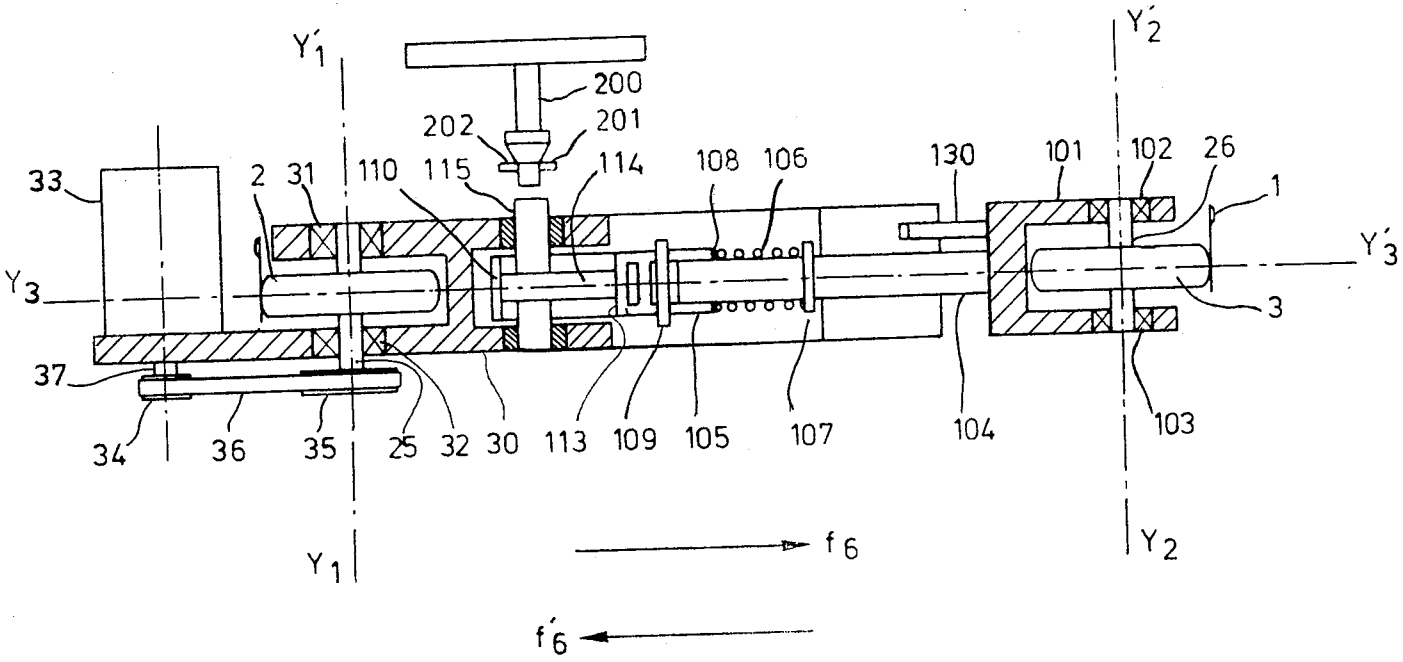

FIG. 4 is a longitudinal sectional view through part of the fitting and tensioning arrangement according to the invention, showing in particular the device for moving the pulleys apart and together.

FIG. 5*a* and 5*b*, 6 and 7 are fragmentary perspective views of the arrangement according to the invention, illustrating the successive operations involved in fitting and tensioning a character-bearing band.

The invention will be better understood if the principles of construction and operation of a printer which employs an endless character-bearing band are first reviewed.

As shown in FIG. 1, the endless character-bearing band 1 is mounted under tension on two pulleys 2 and 3 whose axes of rotation Yl–Y'1, Y2–Y'2 are vertical.

The band 1 carries a plurality of character-bearing fingers, of which only four are shown in FIG. 1*a* in order to simplify the view. This group of four fingers includes character-bearing fingers 5 to 8 and the band 1 is preferably made of a magnetic metallic material.

As shown in FIG. 1*b*, the printer contains a plurality of printing hammers on which only some, namely hammers 9 to 13, are shown.

The endless band 1 moves in a straight line at a constant speed between, on the one hand, hammers 9 to 13 and a print support 14 (paper and inking ribbon) and, on the other hand, a fixed anvil 15.

It will be assumed that pulley 2 is the driving pulley. It is coupled mechanically to the shaft of an electric motor which is not shown in FIG. 1*a*. Pulley 3 has the function of tensioning the band 1. Because of this it is able to move in translation, under the prompting of the fitting and tensioning arrangement according to the invention (not shown in FIGS. 1*a*, 1*b*), in a direction perpendicular to the axes of rotation Y1–Y'1, Y2–Y'2 of the pulleys (this direction being parallel to the direction D in which the character-bearing fingers move past the hammers).

FIG. 2 is a functional block-diagram of the arrangement according to the invention for fitting and tensioning an endless character-bearing band.

The various component parts of this arrangement are:

- a detachable cartridge 20 containing the belt 1,
- a system 100 for opening out pulley 3,
- a member 200 for actuating the opening-out device 100,
- a means 300 for locking the actuating member 200,
- a member 50 for protecting the tops of the character-bearing fingers on the band 1, means 400 for operating the protective member 50.

To fit the character-bearing band 1 into the printer it is necessary for the printer to be at rest. Pulleys 2 and 3 are in the closed up position. The member 200 which actuates the device 100 for opening out pulley 3 is locked by the locking means 300.

The operation of the arrangement for fitting and tensioning the band 1 is as follows:

1. The cartridge 20 is fitted into the printer so that the band 1 fits round the two pulleys 2 and 3. The cartridge 20 acts on the locking means 300, which unlocks the member 200 for actuating the opening out device 100.

2. Member 200 actuates the device 100 for opening out pulley 3. Pulleys 2 and 3 move from the closed-up position to the opened-out position, the effect of which is to tension the band 1. At the same time actuating member 200 acts on the means 400 for operating the protective member 50, which latter comes into position over the tops of the character-bearing fingers on the band 1.

3. Once the band has been tensioned, the locking means 300 again locks the member 200 for actuating the device 100 for opening out pulley 3. The print support 14 is then inserted between the hammers on the one hand and the band 1 and the anvil 15 on the other.

A preferred embodiment of the detachable cartridge 20 is described in U.S. Pat. No. 3,805,697.

As can be seen in FIG. 3, the detachable cartridge 20 has an outer cover 21, and a shell 22 is situated inside the cover close to its right hand end 21D. The cover 21 has an opening 23 and the shell 22 an opening 24, into which openings fit the free ends of shafts 25 and 26, respectively of pulleys 2 and 3.

As can be best seen in FIG. 3*a*, the inner wall of the cover 21 along its left hand end 21G, and the inner wall of the left hand end 22G of the shell 22, each bear a strip of magnetized material 27 against which the character-bearing band 1 is held.

In FIG. 3*a* the device 100 for opening out pulley 3 is represented by a box which is joined to the shaft 26 of the pulley by a phantom line.

When, by means of the opening out device 100, pulley 3 is moved from the closed-up position (FIG. 3*a*) to the opened-out position (FIG. 3*b*), and the shell 22 from its closed-up position in the cover 21 it its opened-out position, the character-bearing band 1 is peeled away from the magnetized strips 27 against which it was being held and is transferred onto pulleys 2 and 3.

The device 100 for opening out pulley 3 is specifically shown in longitudinal section in FIG. 4, as also is a part of the printer. As can been seen in this Figure, the driving pulley 2 is mounted by means of its shaft 25 on a fixed support 30 secured to the frame (not shown) of the printer. Shaft 25 is mounted in bearings 31 and 32. Pulley 2 is driven by an electric-motor 33, via pulleys 34 and 35 which are connected together by a drive belt 36. Pulley 34 is mounted on a shaft 37 of the electric motor 33 and pulley 35 is mounted on the shaft 25 of pulley 2.

The device 100 for opening out pulley 3 includes (see also FIG. 2):

a movable support 101 for pulley 3
a sliding rod 104
a coil spring 106
a pusher 105
a cam 114.

The pulley 3 is mounted in the movable support 101 by means of its shaft 26, which is in turn mounted in bearings 102 and 103 which are secured in support 101.

Support 101 is provided with a small bar 130 which slides in support 30. Rod 104 is secured to support 101 and is similarly slidable in support 30. An axis of symmetry Y3, Y'3 of rod 104 lies in the plane defined by the vertical axes of rotation Y1, Y'1, and Y2, Y'2 of pulleys 2 and 3 and is perpendicular to these axes. In practical terms it can be said that axis Y3, Y'3 is a horizontal axis of symmetry of supports 30 and 101 and of pulleys 2 and 3. The small bar 130 prevents support 101 from turning about axis Y3, Y'3.

Rod 104 and support 101 are able to move in translation along axis Y3, Y'3.

The coil-spring 106 is fitted round the sliding rod 104 between a fixed collar 107 secured to rod 104 and the front face 108 of the pusher 105. Pusher 105 is slidable on the end of rod 104 (see also FIG. 5*a*). Depending on the position which it occupies on the end of rod 104, pusher 105 is capable of compressing spring 106 to a greater or lesser extent. Pusher 105 carries a peg 109 which fits into a slot 119 formed in the sliding rod 104 so that the pusher cannot rotate about axis Y3, Y'3. This is illustrated in greater detail in FIG. 5*b*, which shows how the peg 109 fits into slot 119. The pusher 105 is deliberately omitted from FIG. 5*b*. A horseshoe-shaped yoke 110 is attached by its two ends to the side-walls 111 and 112 of pusher 105.

The cam 114 is able to rotate in the open space within the yoke 110 which is bounded by the rear face 113 of pusher 105. This cam is an eccentric (See FIG. 4 and 5*a*) which is attached to a hollow, circular, cylindrical part 115 mounted in support 30. Two grooves 116 and 117 are cut into the top of part 115. Similarly a slot 118 is cut into the side-wall of this same part. If $d$ is the inside diameter of the hollow cylinder and $e$ the thickness of its cylindrical crown, the depth of slot 118 is virtually equal to $(d + e)$.

The actuating member 200 is formed as a detachable key which has pins 201 and 202 extending from opposite sides thereof. The key 200 may be inserted into part 115 by fitting the pins 200 and 201 at its sides into the grooves 116 and 117, which allows part 115, and thus cam 114, to be turned (see also FIG. 6).

Figure 6:
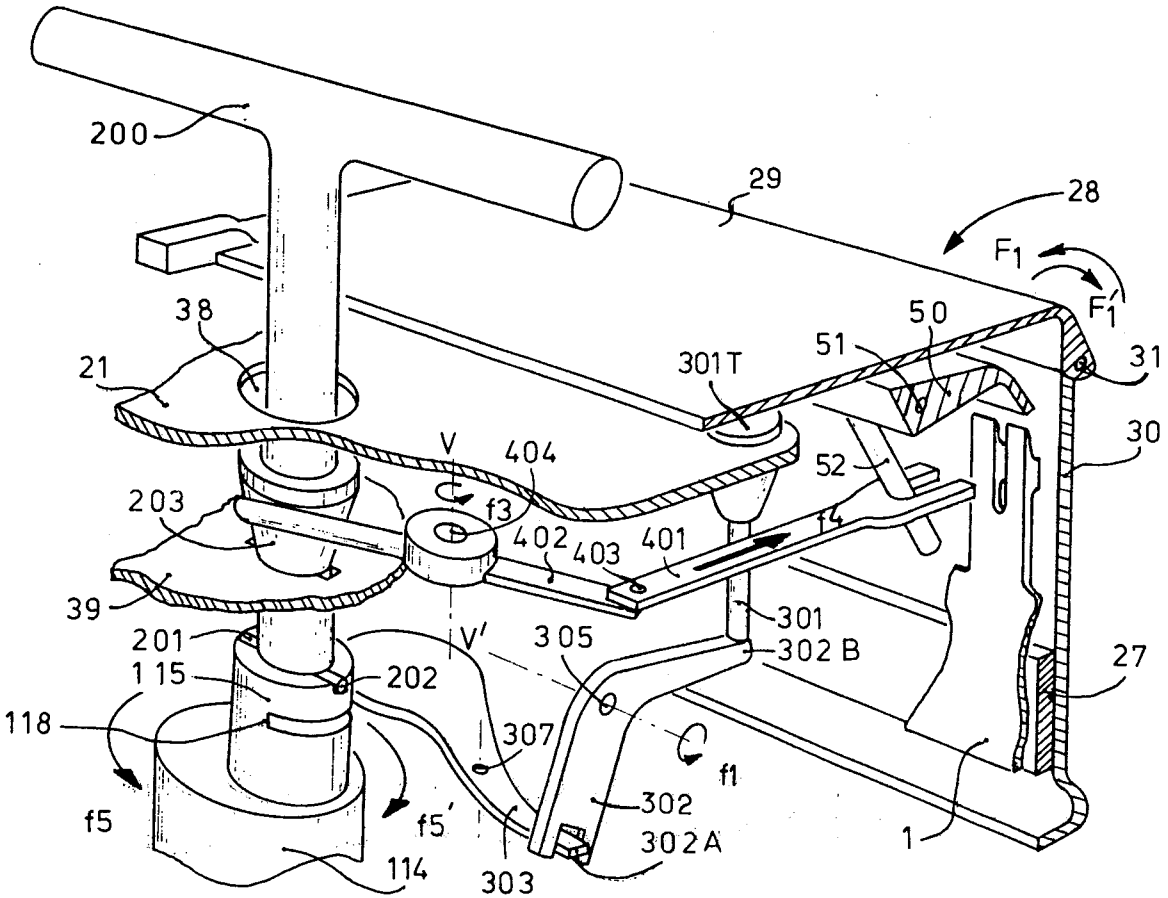
Figure 7:
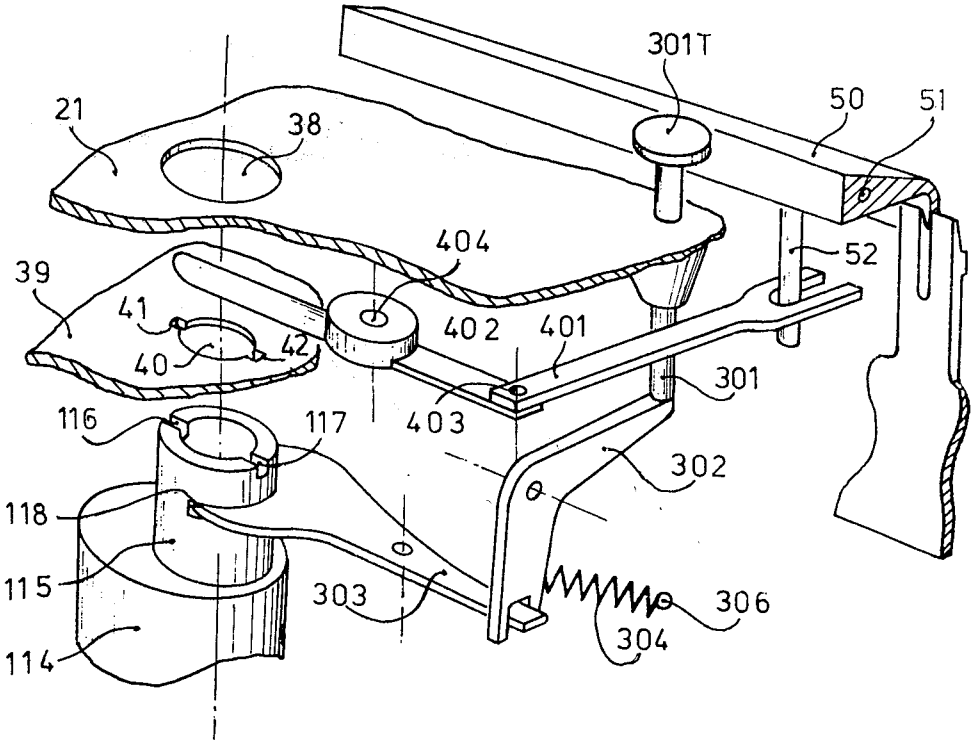

As can be seen from FIGS. 5, 6 and 7, the means 300 for locking the detachable key 200 includes:

a plunger 301;
a first lever 302;
a blocking member 303;
a return spring 304.

The first lever 302 is hinged to the non-illustrated framework of the printer at pivot point 305. It is provided with the return spring 304 which is attached to this same framework at 306. The first lever 302 is able to turn about a horizontal axis Z1, Z2 which passes through the pivot point 305.

The blocking member 303 is hinged to the framework of the printer at pivot point 307 and is able to turn about a vertical axis Z3, Z4 which passes through this point. The shape of the blocking member 303 is such that it is able to insert itself in the slot 118 in the hollow cylindrical part 115. A forked end 302A of the first lever 302 co-operates with the blocking member 303 in such a way that any rotational movement by lever 302 about horizontal axis Z1, Z2 causes blocking member 303 to turn about the vertical axis Z3, Z4.

End 302B of the first lever 302 is in contact with the plunger 301 which is mounted in the cover 21 of the cartridge 20.

This plunger 301 is in turn in contact with the first flap 29 of a retractable assembly 28 associated with the cartridge 20, the assembly also including a second flap 30. Flaps 29 and 30 are hinged together at 31.

The retractable assembly 28 may be folded back onto cover 21 of the cartridge 20 in the direction of arrow F1, when the handle 32 for grasping the cartridge 20, which handle is shown in broken lines in FIG. 5*a*, is itself moved down and back towards the cover in the direction of arrow F2.

The plunger 301 may occupy two positions:

a down position, when the retractable assembly 28 formed by flaps 20 and 30 is occupying the position shown in FIGS. 5 and 6, the flap 29 then exerting pressure on the head 301T of the plunger 301;

an up position, as shown in FIG. 7, when the retractable assembly 28 is folded back onto the cover 21.

A protective cover 50 for protecting the tops of the character-bearing fingers (fingers 5 and 6 are shown in FIGS. 5, 6 and 7) is hinged to the printer at 51. The protective cover 50 is fitted with a return spring 53 which is attached to the framework of the printer at 54. It is also fitted with a small rod 52 which cooperates with the forked end of a second lever 401.

This second lever 401 is coupled to a third lever 402 at pivot 403. The third lever 402 is also hinged to the framework of the printer, at pivot point 404. The second lever 401 is able to move in translation along its longitudinal axis of symmetry, while the third lever 402 is able to turn about a vertical axis of rotation V'V which passes through pivot point 404 (as shown in FIG. 6).

Levers 401 and 402 form the means 400 for operating the protective member 50.

The outer shell 21 of the cartridge 20 contains a hole 38 through which may be inserted the key 200. An intervening plate 39, which is attached to the framework of the printer and is situated below the cover 21, is pierced by a circular hole 40 provided with diametrically opposed lateral cut-outs 41 and 42.

If it is assumed, for simplicity's sake, that the lateral cut-outs 41 and 42 in hole 40 on the one hand and grooves 116 and 117 on the other are comparable to segments of a straight line, it can be said that when cam 114 and hollow part 115 are in the inactive position (as in FIG. 5) cut-outs 41 and 42 and grooves 116 and 117 are parallel and situated in the same vertical plane.

The details operation of the arrangement according to the invention for fitting and tensioning a character-bearing band 1, is explained below and illustrated in FIGS. 5 to 7.

1. FIRST OPERATION: FITTING THE CARTRIDGE 20 INTO THE PRINTER. FIG. 5

The printer is not running. Pulleys 2 and 3 are in the closed-up position. Blocking member 303 is resting in the slot 118 in the hollow cylindrical part 115. Using the handle 32, the cartridge 20 is taken from the point where it was stored in the printer. The cartridge is fitted into the printer over the top of the two pulleys 2 and 3. The shell 22 is in the closed-up position of FIG. 3*a* in the cover 21.

When the cartridge is inserted in the printer, plunger 301 exerts a pressure on end 302B of the first lever 302, which pivots about axis Z1, Z2 in the direction indicated by arrow *f*1. As it pivots, the first lever 302 is restrained by spring 304. The pivoting movement of the first lever 302 causes the blocking member 303 to rotate about axis Z3, Z4 in the direction of arrow *f*2 and to move out of the slot 118 in the cylindrical part 114. The handle 32 is then moved back onto the cover 21 in the direction of arrow F2. The cartridge 20 is secured firmly in position in the printer by locking means which are not shown. It is then possible to begin the second operation.

2. OPERATION 2: INSERTING THE KEY 200 IN PART 115. FIG. 6

The key 200 is inserted through holes 38 and 40 and then into part 115. When it is inserted, pins 200 and 202 pass through the lateral cut-outs 41 and 42 in the circular hole 40 in plate 39 before entering the grooves 116 and 117 in the hollow cylindrical part 115. The cylindrical end of the key 200 fits inside part 115. As the key 200 is pressed down into part 115, the taper 203 on the key causes the third lever 402 to turn in the direction of arrow *f*3 about axis V'V. The third lever in turn causes lever 401 to move in translation in the direction of arrow *f*4. Lever 401 pushes on the small rod 52 and causes the protective cover 50 to rise by turning about its hinge 51. The third operation may then begin.

3. OPERATION 3: TENSIONING THE BAND BY OPENING OUT PULLEY 3. FIGS. 4, 5 and 6.

Spring 106 is compressed with a force $F_T$ between collar 107 and face 108 of pusher 105. The peg 109 in pusher 105 is held hard against face FA of the slot 119 in the sliding rod 104.

The hollow cylindrical part 115 and the cam 114 are rotated half a turn in the direction of arrow *f*5 (FIG. 5 and 6) by means of key 200. The cam comes to bear against the rear face 113 of pusher 105. The operation of tensioning the character-bearing band 1 may be divided into two successive stages.

a. first stage: (Which is equivalent to rotating the cam through three-quarters of its total rotation)

When pressure is exerted by cam 114 against the rear face 113 of pusher 105, the tension force $F_T$ from spring 106 is sufficient to move the sliding rod 104, the support 101 for the pulley 3 and the spring 106 in translation towards the right in the direction of arrow f6 (FIGS. 4 and 5) until the character-bearing band 1 has freed itself from the strips of magnetized material 27 in the cartridge 20 and has moved across onto pulleys 2 and 3. The shell 22 is then in the opened-out position in the cover 21. The band is still not under maximum tension. This is done in the second stage.

b. second stage: (equivalent to rotating the cam through the last quarter of its rotation)

Turning of the cam 114 continues. Rod 104 moves practically no further. Pusher 105 slides on the end of the sliding rod 104 until peg 109 comes to a halt near face FA' of slot 119, without touching this face. (FIG. 5*b*). During this time, spring 116 is being compressed between collar 107 and face 108 of pusher 105. Let Fc be the final compressive force on spring 106. Force Fc is greater than force FT. Band 1 is tensioned on the two pulleys with a force Fc.

It can be seen that the force which holds the characterbearing band 1 tensioned on pulleys 2 and 3 is the same as the compression force on spring 106 which is obtained in the last few degrees of rotation of cam 114. This provides the following advantages:

It integrates the variations of distances between the axes of rotation of the pulleys which may be caused by differences in circumference between one band and another;

The spring is compressed over a small distance and at a time when the angular position of the cam makes it necessary for the operator to exert only a slight torque on the detachable key 200.

It can also be seen that, while the cam 114 is being partially turned towards its full operation position, since the grooves 116 and 117 and thus the pins 201 and 202 are no longer parallel with cut-outs 41 and 42 in hole 40, it is impossible for the detachable key to be withdrawn through the hole, which prevents the protective cover 50 from dropping onto the character-bearing band 1 and damaging it.

OPERATION 4: WITHDRAWING THE KEY 200. (FIG. 7).

The second and third levers 401 and 402 and the protective cover 50 return to their original position (that shown in FIG. 5). The detachable assembly 28 formed by the two flaps 29 and 30 can be raised and then folded back onto the cover 21 in the direction of arrow F1. The print support 14 is inserted between the hammers and the character-bearing band 1. The tops of the character-bearing fingers are protected by the cover 50. Raising flap 29 allows plunger 301 to lift and thus to cease exerting any force on the first lever 302. The latter, urged by spring 304, pivots about its axis of rotation Z1, Z2 in the direction of arrow *f'*1, the direction of which is opposite from that of arrow *f*1, and this allows the blocking member 303 to re-introduce itself into the slot 118 in the hollow cylindrical part 115.

Thus, with the two pulleys 2 and 3 in the opened-out position and the character-bearing band 1 tensioned, it is impossible for the key 200 to be inserted in part 115. In other words, no mishandling is possible which might act on the pulley 3 and thus relax the band while characters are being printed.

It is clear that if it is desired to relax the character-bearing band 1 and then remove the cartridge 20 from the printer, the procedure adopted is the reverse of that just described for fitting the cartridge 20 and tensioning the band 1. Operations then take place as follows, once the print support 14 has been removed from the printer.

OPERATION 5: INSERTION OF KEY 200

The detachable assembly 28 formed by the two flaps 29 and 30 is closed down in the direction of arrow F'1, i.e. in the opposite direction of arrow F1. Under the prompting of plunger 301, first lever 302 and spring 304, blocking member 303 withdraws from the slot 118 in part 115. The key 200 may be inserted into part 115, which causes the third lever 402 to turn about V'V and the second lever 401 to move in translation and the cover 50 to lift as a consequence (FIG. 6).

OPERATION 6: RELAXATION OF THE BAND 1

By means of key 200, cam 114 is turned half a turn in the direction indicated by arrow *f'*5, which is the opposite to that indicated by arrow *f*5.

The operation of relaxing the character-bearing band 1 takes place in two stages (like the tensioning operation).

a. first stage: (corresponding to turning the cam 114 through a quarter of the total rotation)

Support 101 and sliding rod 104 do not move. Only the pusher 105 slides on the end of rod 104 until peg 109 comes into contact with fact FA of slot 119. During this time, spring 106 relaxes. The tension force on it reverts to a value equal to force FT.

b. second stage: (corresponding to turning the cam 114 through approximately three-quarters of its total rotation).

Rod 104 and support 101 are moved in translation in the direction of allow *f'*6 (which is the opposite direction to arrow *f*6) until the two pulleys 2 and 3 are in the closed-up position. Band 1 frees itself from pulleys 2 and 3 and is transferred to the strips of magnetized material 27 in the cover 21.

OPERATION 7: WITHDRAWAL OF KEY 200

The third and second levers 401 and 402 return to their original positions and the protective cover 50 falls back into place (see FIG. 5).

OPERATION 8: WITHDRAWING THE CARTRIDGE

Since the plunger 301 is withdrawn simultaneously with the cartridge 20 and no longer exerts a pressure on the end of the first lever 302, this latter pivots about axis Z1, Z2 in the direction indicated by arrow *f'*1, which allows blocking member 303 to insert itself into slot 118 in the hollow cylindrical part 115.

Although the arrangement for fitting and tensioning character-bearing bands which is described above and shown in the accompanying drawings consists solely of mechanical parts, it is clear that a fitting and tensioning arrangement which incorporates electromechanical parts, for example, would not exceed the scope of the invention.

I claim:

1. An arrangement for fitting and tensioning an endless character-bearing band in a printer of the type having a framework and wherein the endless character-bearing band is of the type having a plurality of character-bearing fingers and the printer having first and second pulleys on which the band is mounted, the pulleys having axes of rotation which are parallel with the distance between the axes of rotation being adjustable between a position in which the pulleys are closed-up and the band is not under tension and a position in which the pulleys are opened-out and the band is under tension, the printer being of the type of having means for adjusting the spacing of the first and second pulleys and a protective member hinged to the framework of the printer for protecting the character-bearing fingers by covering the top of said fingers, said arrangement including a detachable cartridge containing the band and being operatively associated with said means for adjusting the spacing of the pulleys; the improvement residing in said fitting and tensioning arrangement further including operating means connected to said protective member for operating said protective member, locking means, actuating means for actuating said means for adjusting the spacing of the pulleys, said locking means including means preventing the use of said actuating means in the absence of a cartridge in the printer, said locking means further including means actuated in response to the positioning of a cartridge for moving said locking means to a released position, said operating means including means engageable by said actuating means for operating said operating means to move said protective member above the top of said character-fingers.

2. An arrangement according to claim 1, wherein said first pulley is fixed and said second pulley is mounted on a support movable in translation in a direction parallel to an axis perpendicular to the axes of rotation and contained in a plane containing said axes.

3. An arrangement according to claim 2, said endless character-bearing band is formed of a magnetic metallic material, said detachable cartridge including a casing capable of enclosing the two pulleys whatever their relative position, said casing comprising a cover having means for fixedly positioning said cover relative to the axis of said fixed pulley and a shell having means for positioning said shell relative to the axis of said movable pulley for movement therewith, means mounting said shell for sliding within said cover in the said direction of movement of said movable pulley and strips of magnetized material attached to inside walls of said cover and said shell with said endless band being held against said strips of magnetized material when said pulleys are in their closed-up position.

4. The arrangement according to claim 3 wherein said system for opening out said pulleys includes a cam, a pusher, a sliding rod, and a spring, said cam being in contact with said pusher and having means thereon to effect turning thereof by said actuating means, said sliding rod being secured at a first end thereof to said movable support, said sliding rod having spring abutment means, said spring being engaged between said pusher and said spring abutment means, said pusher being slidably mounted on a second end of said sliding rod for movement towards and away from said spring abutment means for altering the compression of said spring, said cam when turned by said actuating means being operable to first cause said pusher, said spring, said sliding rod, and said support to move in translation in the said direction and then increase the compression on said spring until a force is attained which causes said endless character-bearing band to be held under tension.

5. An arrangement according to claim 4 wherein said actuating member is in the form of a detachable key, said cam having an opening into which said key is inserted once the detachable cartridge has been fitted into the printer.

6. An arrangement according to claim 5, wherein said locking means includes a blocking member, a lever, a plunger, means for hinging said blocking member and said lever to a framework of the printer for movement in rotation, said plunger being in contact with a first end of said lever, said lever having a second end engaging a first end of said blocking member, said blocking member having a second end normally inserted in the opening in the said cam when the detachable cartridge is not fitted to the printer, and said plunger being operable to exert a pressure on said first end of said lever when the cartridge is fitted into the printer causing said lever and said locking member to rotate with said second end of said blocking member being withdrawn from the opening in said cam.

7. An arrangement according to claim 4, characterized in that the member for protecting the fingers is formed by a protective cover which is hinged to the framework of the printer and is arranged near the tops of the character-bearing fingers.

8. An arrangement according to claim 7 wherein said actuating member is in the form of a detachable key, said cam having an opening into which said key is inserted once the detachable cartridge has been fitted into the printer.

9. An arrangement according to claim 8, wherein said operating means includes a first lever, a second lever, said first and second levers having a common pivot point, said first lever being movable in translation and said second lever being movable in rotation, said second lever and said detachable key having cooperating engageable portions, said first lever having a portion operable on said protective cover, the relationship of said detachable key, said first and second levers and said protective cover being one wherein the insertion of said detachable key into the opening in said cam causes said second lever to rotate and said first lever to move in translation which in turn causes said protective cover to lift as it rotates about its hinge.

10. An arrangement according to claim 9 wherein said cooperable engaging portion of said detachable key is in the form of a tapered cam.

* * * * *